US005203758A

United States Patent [19]

Achelpohl et al.

[11] Patent Number: 5,203,758

[45] Date of Patent: Apr. 20, 1993

[54] METHOD FOR MANUFACTURING A SACK OR BAG WITH A BOTTOM BEING RECTANGULAR IN THE FILLED STATE AND WITH A HANDLE, AND A SACK OR BAG MANUFACTURED IN ACCORDANCE WITH SAID METHOD

[75] Inventors: Fritz Achelpohl; Werner Jürgens, both of Lengerich, Fed. Rep. of Germany

[73] Assignee: Windmöller & Hölscher, Lengerich, Fed. Rep. of Germany

[21] Appl. No.: 852,006

[22] Filed: Mar. 16, 1992

[30] Foreign Application Priority Data

Mar. 22, 1991 [DE] Fed. Rep. of Germany ..... 4109568
Apr. 19, 1991 [DE] Fed. Rep. of Germany ..... 4112900

[51] Int. Cl.[5] ..... B31B 37/14; B31B 33/26; B31B 33/62; B31B 37/86

[52] U.S. Cl. ..... 493/195; 493/226; 493/231; 493/264; 493/926

[58] Field of Search ..... 493/194, 195, 221, 226, 493/231, 232, 243, 253, 255, 264, 265, 926

[56] References Cited

U.S. PATENT DOCUMENTS

| | | | |
|---|---|---|---|
| 3,472,130 | 10/1969 | Brockmuller | 493/213 |
| 3,605,570 | 9/1971 | Goodwin | 497/226 |
| 3,611,883 | 10/1971 | Grob | 493/221 |
| 3,853,040 | 12/1974 | Achelpohl | 493/255 |
| 4,018,142 | 4/1977 | Canno | 493/221 |

FOREIGN PATENT DOCUMENTS

| | | |
|---|---|---|
| 1196848 | 11/1985 | Canada . |
| 1245699 | 7/1967 | Fed. Rep. of Germany . |
| 8115909 | 9/1981 | Fed. Rep. of Germany . |
| 8207989 | 7/1982 | Fed. Rep. of Germany . |
| 3629852 | 3/1988 | Fed. Rep. of Germany . |
| 4021801 | 10/1991 | Fed. Rep. of Germany . |
| 4014600 | 11/1991 | Fed. Rep. of Germany . |
| 2016365 | 9/1979 | United Kingdom . |

*Primary Examiner*—William E. Terrell
*Attorney, Agent, or Firm*—Keck, Mahin & Cate

[57] ABSTRACT

This invention relates to a method for manufacturing a sack or bag with a bottom being rectangular in the filled state and with a handle portion, and it also relates to sacks or bags manufactured in accordance with this method. For the solution of the problem to simplify already known methods, onto a continuously advanced flat web two strips of sealing-wax which are in parallel to each other and perpendicular to the lateral edges are applied on one side at distances of one bag length, respectively, and at corresponding locations of the back side of the flat web four short strips of sealing-wax are applied, and between the strips of sealing-wax two reinforcements are glued thereto with their whole surface. Below the first reinforcement a folded sheet with a leg is glued, whereas the other leg is folded back thereonto. Below the second reinforcement an area is provided with glue which in size corresponds to the leg. On one side of the flat web an adhesive strip is applied. By forming lateral folds the web is folded to a tube such that the free leg is arranged on the glued area and that simultaneously the two reinforcements are arranged above each other. The sealing-wax strips are reactivated and fold edges are pregrooved. Finally, in the section of the reinforcements lying on top of each other a griphole is punched. The still open bottom is folded to be closed in the usual manner after filling of the bag.

5 Claims, 24 Drawing Sheets

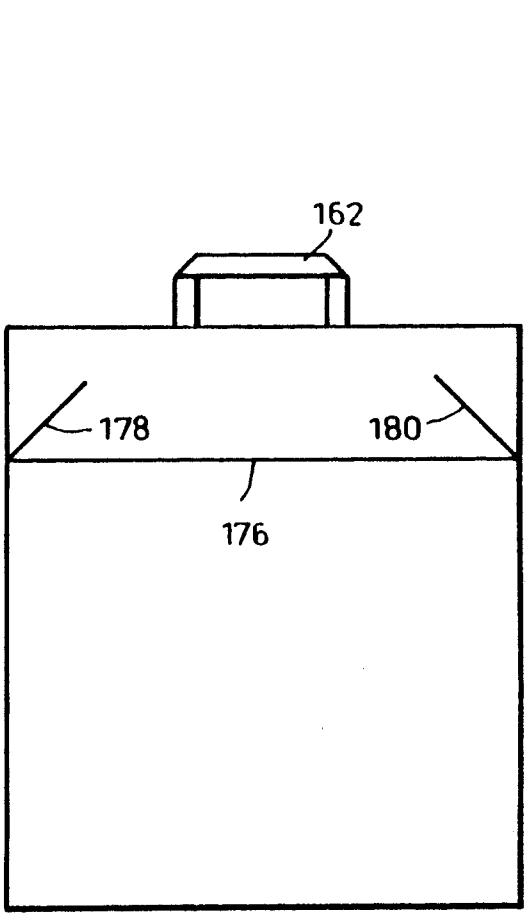
Fig.33
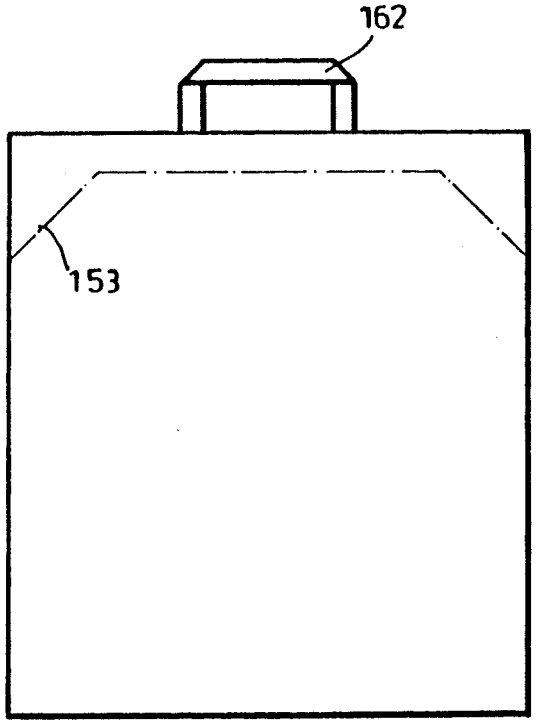
Fig.32
Fig.31a
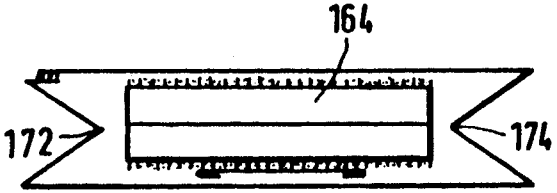
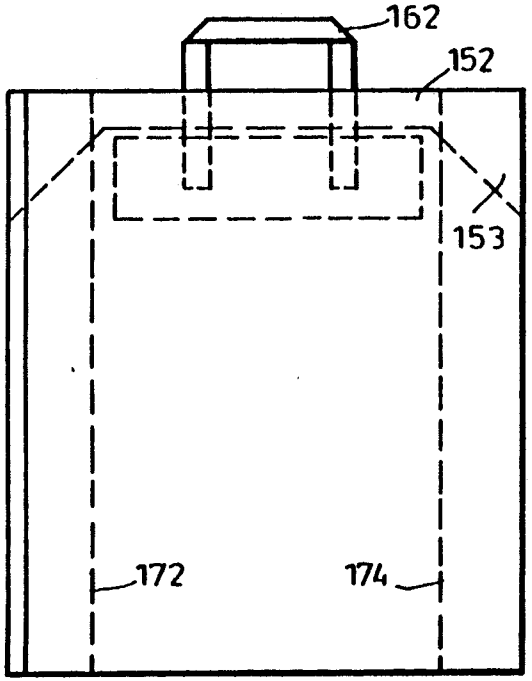
Fig.31

METHOD FOR MANUFACTURING A SACK OR BAG WITH A BOTTOM BEING RECTANGULAR IN THE FILLED STATE AND WITH A HANDLE, AND A SACK OR BAG MANUFACTURED IN ACCORDANCE WITH SAID METHOD

FIELD OF THE INVENTION

This invention relates to a method for manufacturing a sack or bag with a bottom being rectangular in the filled state and with a handle portion, and it also relates to a sack or bag manufactured in accordance with said method.

BACKGROUND

Sacks or bags of this kind are for instance known from the German Utility Models 81 15 909 and 82 07 889. Said known sacks or bags, however, show the drawback that the leg-like strips forming a bottom leaf, so to speak, which in their middle region are connected with the web section being provided with the griphole, are glued with the bottom all-over or nearly allover, so that through the web section, i.e. in the region of the longitudinal center plane running through the bottom of the sack, considerable strains are exercised on the bottom during carrying, said strains resulting from the fact that the forces exercised by the web section are introduced therein substantially in the region of a line centrically extending through the bottom square. In order to avoid said drawback, in the German patent application P 40 12 896.2 a sack or bag was described which is formed by side tucks partially overlapping corner tucks, and the handle portion joined thereto consists of a middle web section with the griphole and lateral leg-like strips of flexible material being connected therewith, wherein the bottom mounted thereon is conventionally glued or welded to a leaf connected sealing-ly with the inner edges of the corner tucks and at least with the inner edges of the side tucks adjacent to their fold lines, wherein the handle portion is inserted in the still open bottom, and the leg-like strips thereof are at least partially covered by the side tucks and glued or welded thereto. In this sack or bag, the side of the lateral leg-like strips of the handle portion facing the leaf constituted by e.g. a piece of paper or foil, wherein said strips carry in the center thereof the web section having the griphole, is not glued to said leaf, but the side tucks overlap the lateral leg-like strips and are glued or welded thereto at the sides thereof at which also the middle web section with the griphole is located. Said sack or bag, therefore, is characterized by a tunnel which is formed between the lower side of the handle portion and the inner side of the handle portion of the leaf. Due to this structure, through the middle web section and the leg-like strips connected therewith, the carrying forces are substantially directly introduced into the side walls of the filled sack or bag, so that the handle portion can accept considerably greater carrying forces without the sack being damaged thereby or bottom parts being stripped thereoff.

But it has been proved to be disadvantageous that the sack or bag described above cannot be easily and simply produced by machines. Also the method for manufacturing a sack or bag with a tunnel of the kind mentioned above, as described in the German patent application P 40 14 600.6, is relatively complicated.

SUMMARY OF THE INVENTION

It is an object of the present invention to provide a method for manufacturing the sack or bag of the generic type by which said sack or bag can be easily and economically produced by machines in a production line.

This problem is solved according to the invention by the method steps according to claims 1, 3, 5 or 8.

The method steps according to the invention and according to claims 5 and 8 correspond substantially to those according to claims 1 or 3. In contrast to the steps of claims 1 or 3, the steps according to claims 5 or 8, however, have relatively broad strips of reactivatable adhesive or sealing-wax which, in the section of the later lateral folds, are provided with two triangular flat projections, respectively, which allow that in the finished lateral fold bag after activation of the adhesive or the sealing-wax the corners can additionally be glued with each other. Therefrom results an improved edge rigidity of the bottom which leads to an exact and stable formation of the edges in the bottom region of the sack or the bag.

In contrast to the known method, the sack or bag manufactured in accordance with the invention does not have a cross-bottom with an integrated handle or handle portions. In this case, a favourable introduction of force is not obtained by a tunnel formation but by the folded sheet which is glued with the two side walls below the handle. Advantageously, the sheet can be a sheet only folded over once which needs not be prefabricated.

An advantage of the manufacturing method according to claim 1 lies in the fact that the carrying handle is directly incorporated into the bottom during manufacturing. Thus, additional working cycles like the production of handle portions and the gluing thereof are not required.

A sack or bag being manufactured in accordance with one of the methods according to the invention consists preferably of a single material. Thereby the suitability for recycling of the sack or bag is improved It is particularly advantageous that the sack or bag consists of paper.

Embodiments of the invention will now be described in the following with reference to the drwaings.

BRIEF DESCRIPTION OF THE DRAWING

FIG. 26 to 34 show a fourth embodiment of the method according to the invention for the manufacture of a sack or a bag.

DETAILED DESCRIPTION OF PREFERRED EMBODIMENTS

First of all, the individual method steps of the first embodiment of the method according to the invention for the manufacture of a sack or bag—in the present case a paper-napkin bag with a kind of pinch-bottom—will be described with referene to FIGS. 1 through 8.

Figure 1:
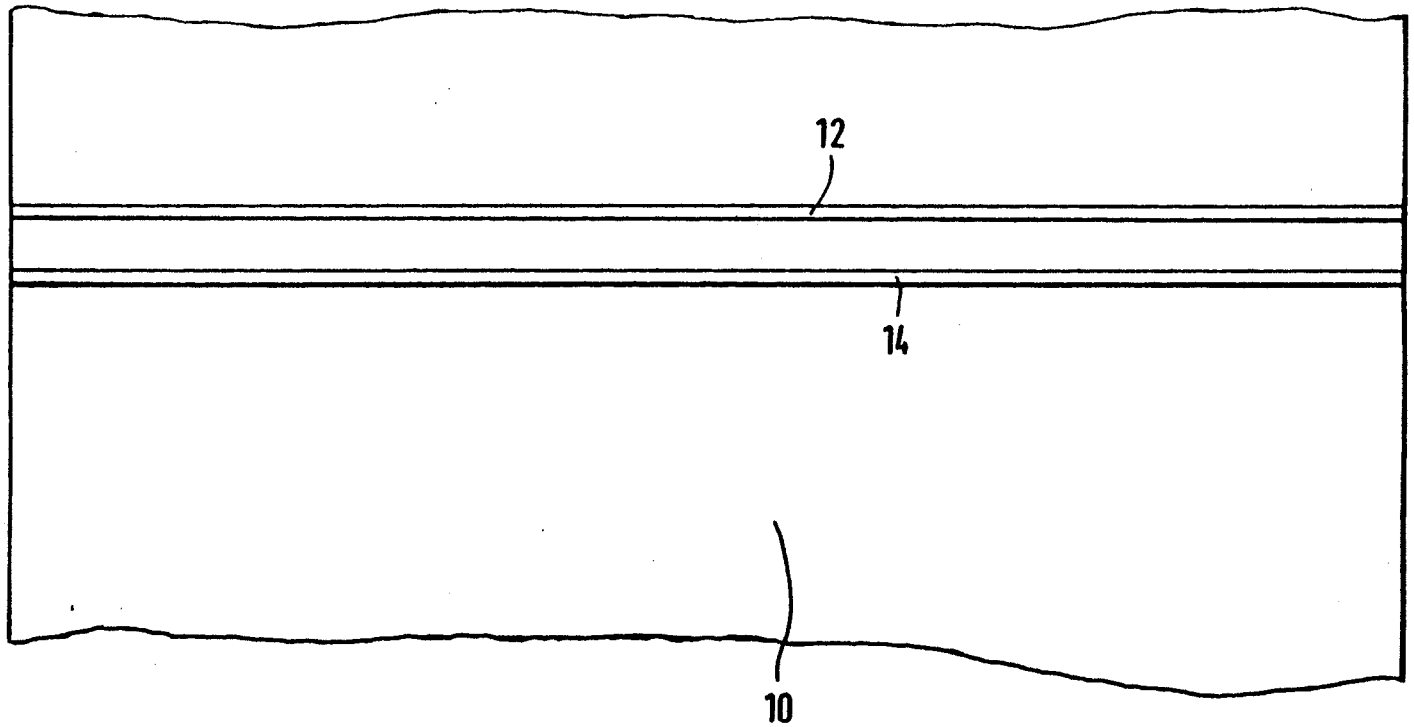
FIG. 1 to 8 show the steps of a first method according to the invention for the manufacture of a sack or bag.
Figure 2:
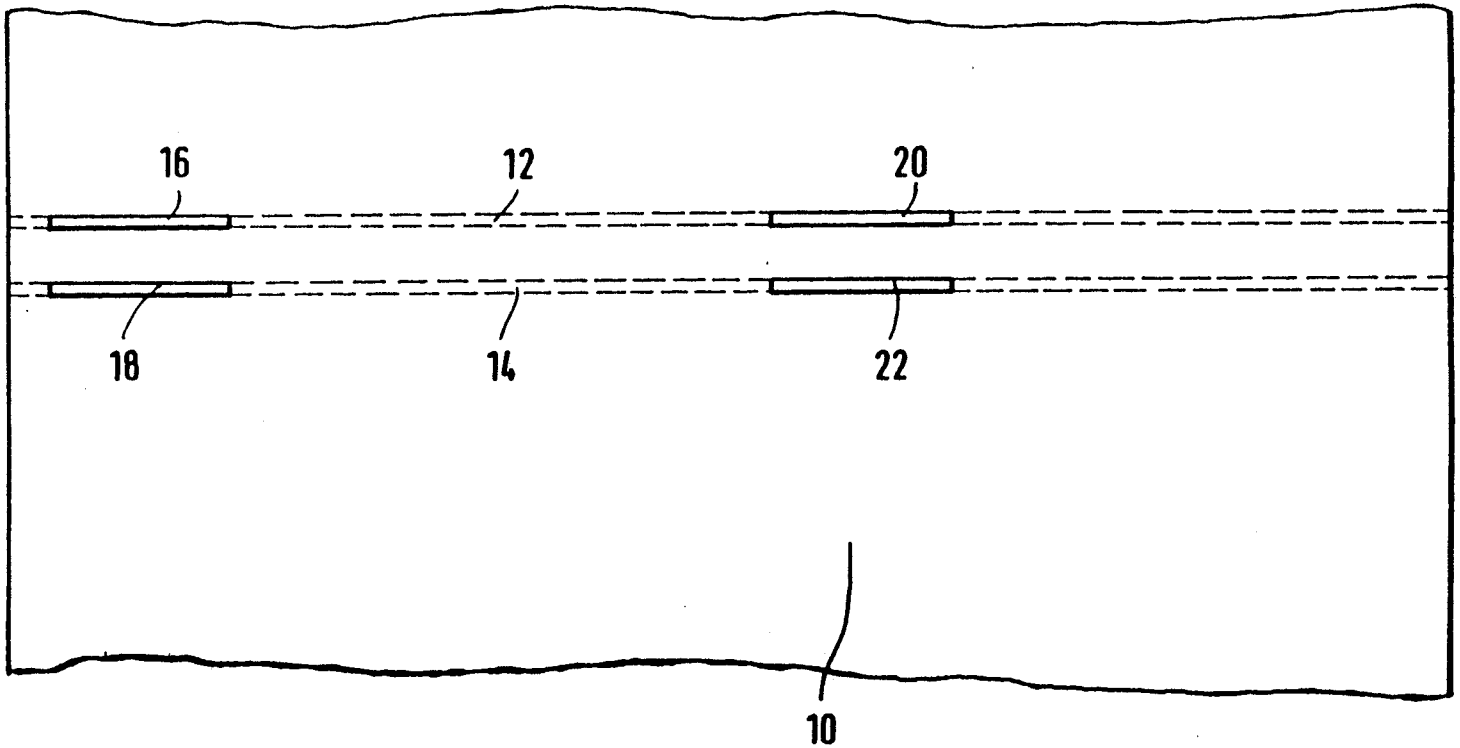
Figure 3:
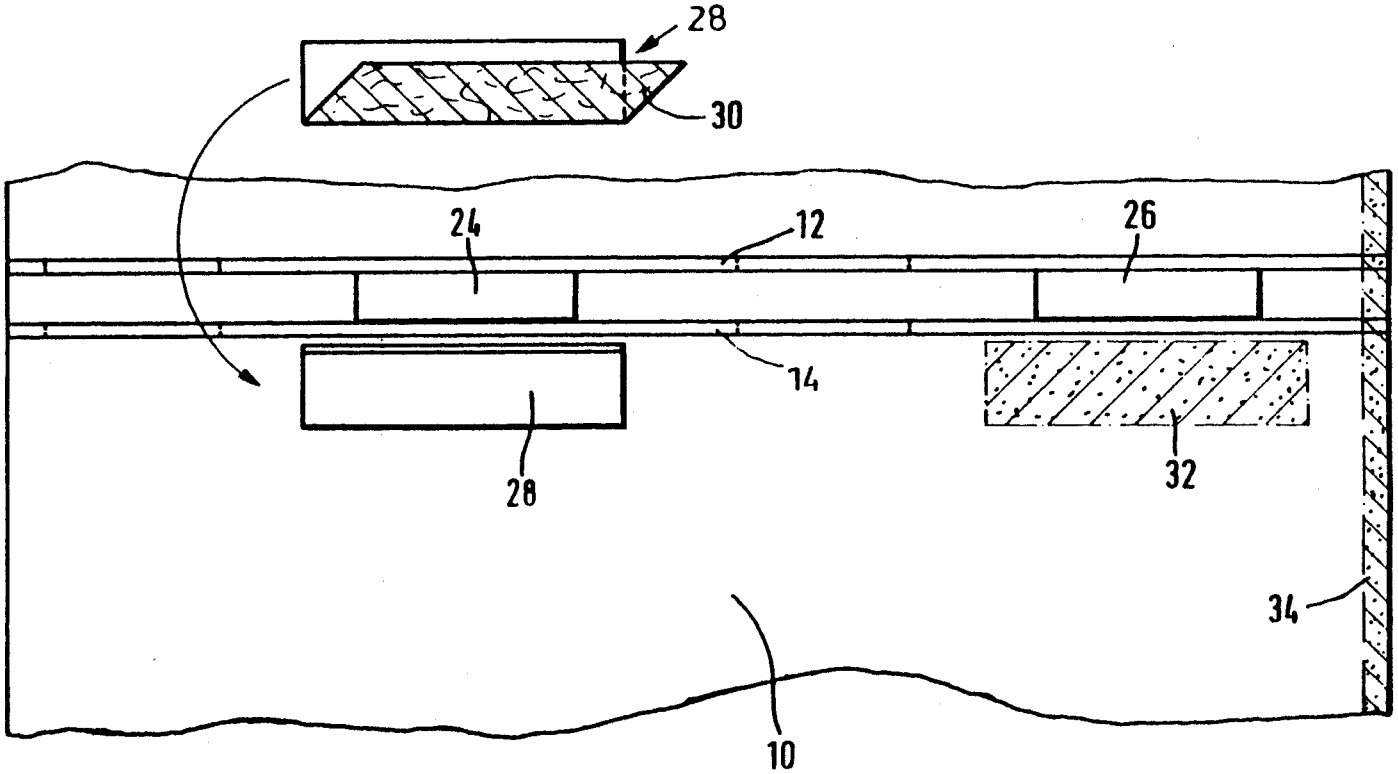

Onto a continuously advanced flat web 10 the front side of which is represented in FIG. 1, two strips 12, 14 of reactivatable adhesive or sealing-wax and extending in parallel to each other and vertically to the lateral edges are put at distances of one bag length, respectively. In FIG. 2 the flat web is represented from the back and the corresponding strips 12 and 14 are indicated by dashed lines as they are arranged on the opposite side. On said back side several strips 16, 18, 20 and 22 are put in congruence with strips 12, 14 arranged on the other side, wherein the strips 16, 18, 20 and 22 have substantially the same length and lateron are used to stick together the bottom portion to be formed of the lateral folds to be formed.

In FIG. 3 the flat web 10 is again shown from the front (see FIG. 1). Between the strips 12, 14 reinforcements 24, 26 spaced apart from each other are glued thereon with their whole surface. Said reinforcements advantageously consist of solid cardboard. If, however, the material of the flat web 10 as such already has a high resistance to tearing, the reinforcements 24 and 26 can also be omitted.

Below and onto the reinforcement 24 a folded sheet 28 is glued. A free leg of said folded sheet 28 is folded back onto the glued leg. Below the reinforcement 26 there is provided an area 32 covered with glue which in size corresponds to the area of the free leg 30 of the folded sheet 28. On the lateral edge of the flat web 10 there is applied an adhesive strip 34.

Figures 4, 4A, 5, 6:
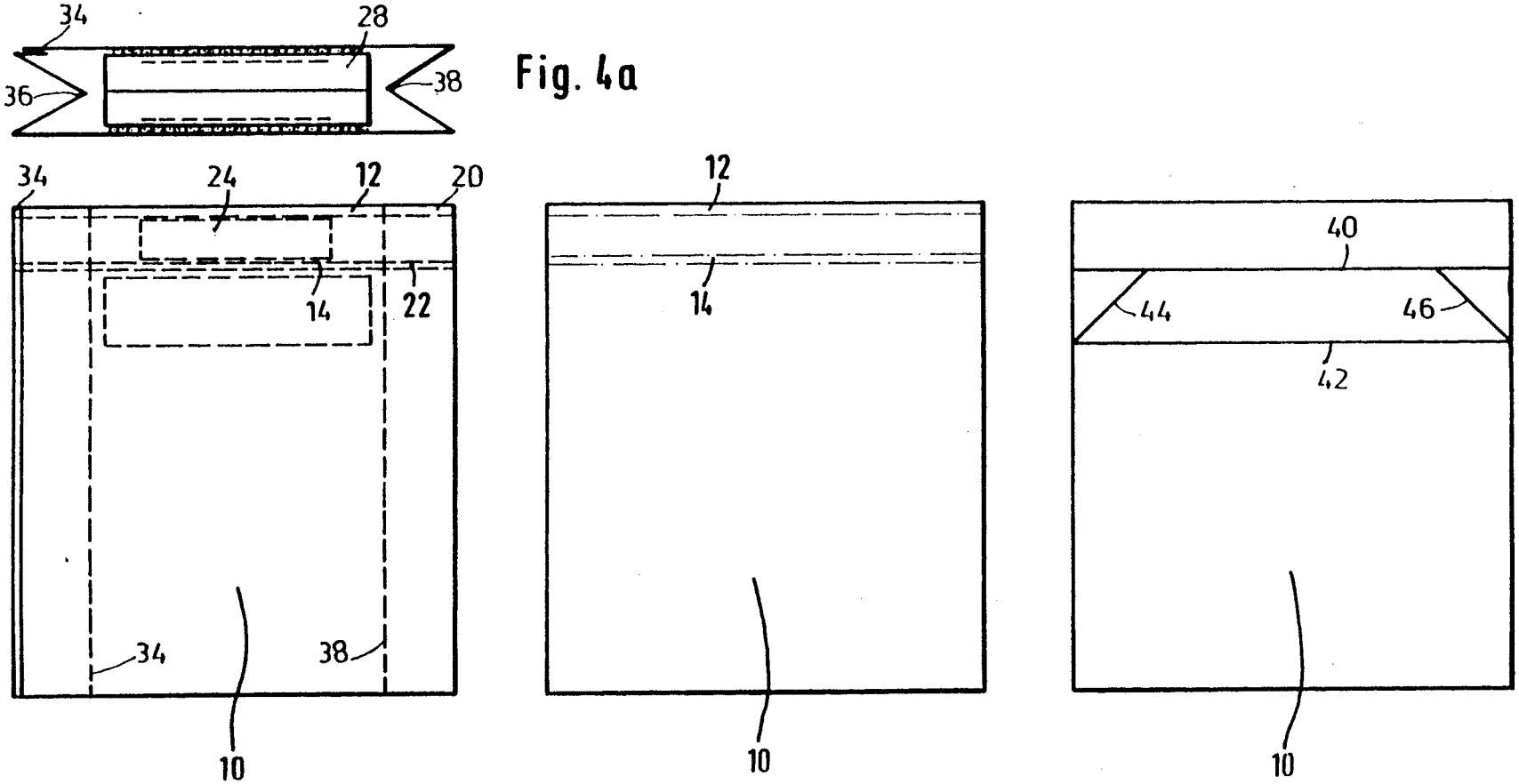

Then the flat web 10 is folded to a tube with lateral folds 36 and 38, said tube, after an adequate cutting to size, having the form as indicated in FIG. 4. In FIG. 4*a* the bag which is open at the bottom is slightly pulled apart. At the center of the drawing, the sheet 28 glued to the sides of the bag is represented. As becomes obvious from FIG. 4, the web is folded such that the free leg 30 is arranged on the glued area 32 and that simultaneously the two reinforcements 24 and 26 are arranged on top of each other.

In the method step as represented in FIG. 5, the reactivatable adhesive strips or sealing-wax strips 12 and 14 are activated by corresponding heated rollers, i.e. they are glued with each other. Additionally, also sealing-wax strips 16 and 18 are glued with each other in the lateral fold 36, and the strips 20 and 22 are glued with each other in the lateral fold 38.

In the method step as shown in FIG. 6, the fold edges are pregrooved. Therein approximately below the sealing-wax strip 14 which has been activated in the meantime a fold edge 40 which extends in parallel to the strip 14, is pregrooved and a fold edge 42 is pregrooved in a position displaced in parallel thereto in direction towards the open end of the bag.

Figure 7:
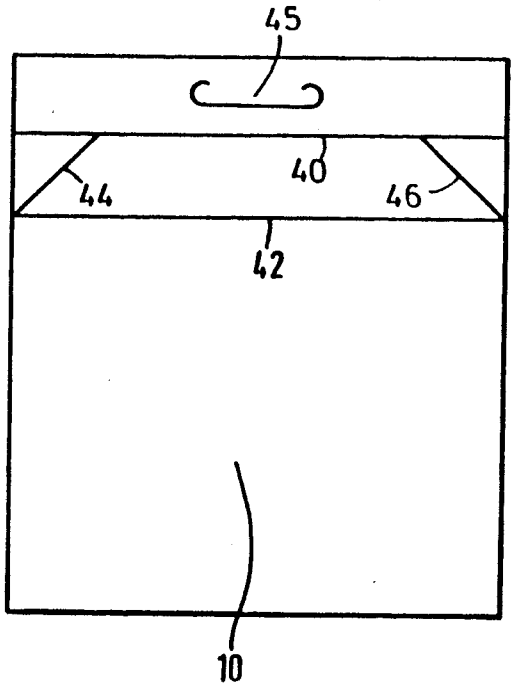

In the method step as shown in FIG. 7 a grip hole punching 45 in the section of the reinforcements 24 and 26 is provided.

Figure 8:
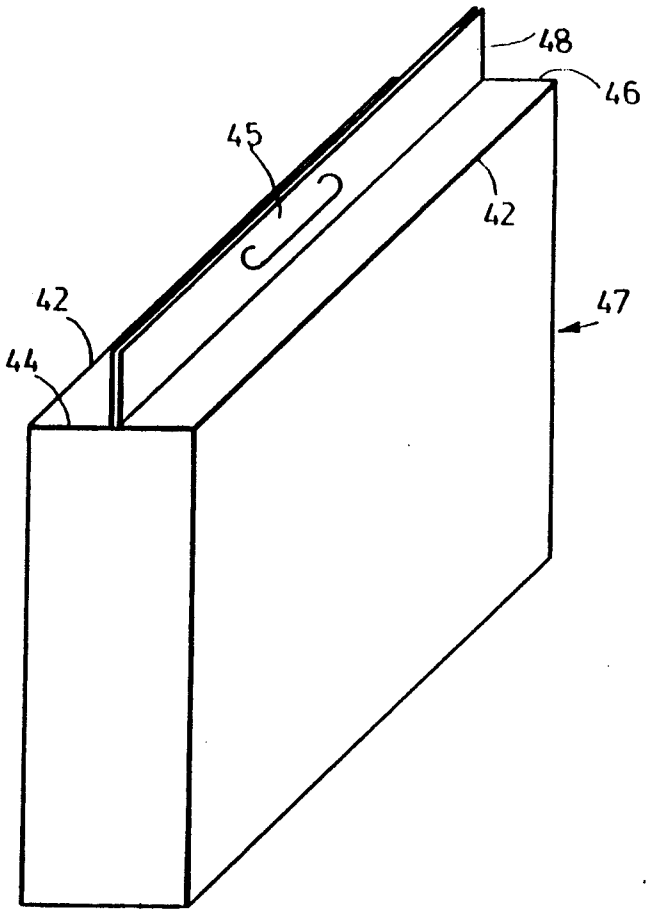

The napkin bag prepared in that way is then filled from below and closed in the lower section in a known manner, whereby the bundle 47 represented in FIG. 8 is obtained. In this bundle 47 a carrying handle 48 with grip hole punching 45 is formed, said ahndle 48 standing in a vertical position to the rectangular bottom of the bag 47. Such a bag is particularly suitable for being stacked side by side, i.e. lateral surface next to lateral surface and front surface next to front surface.

Figure 9:
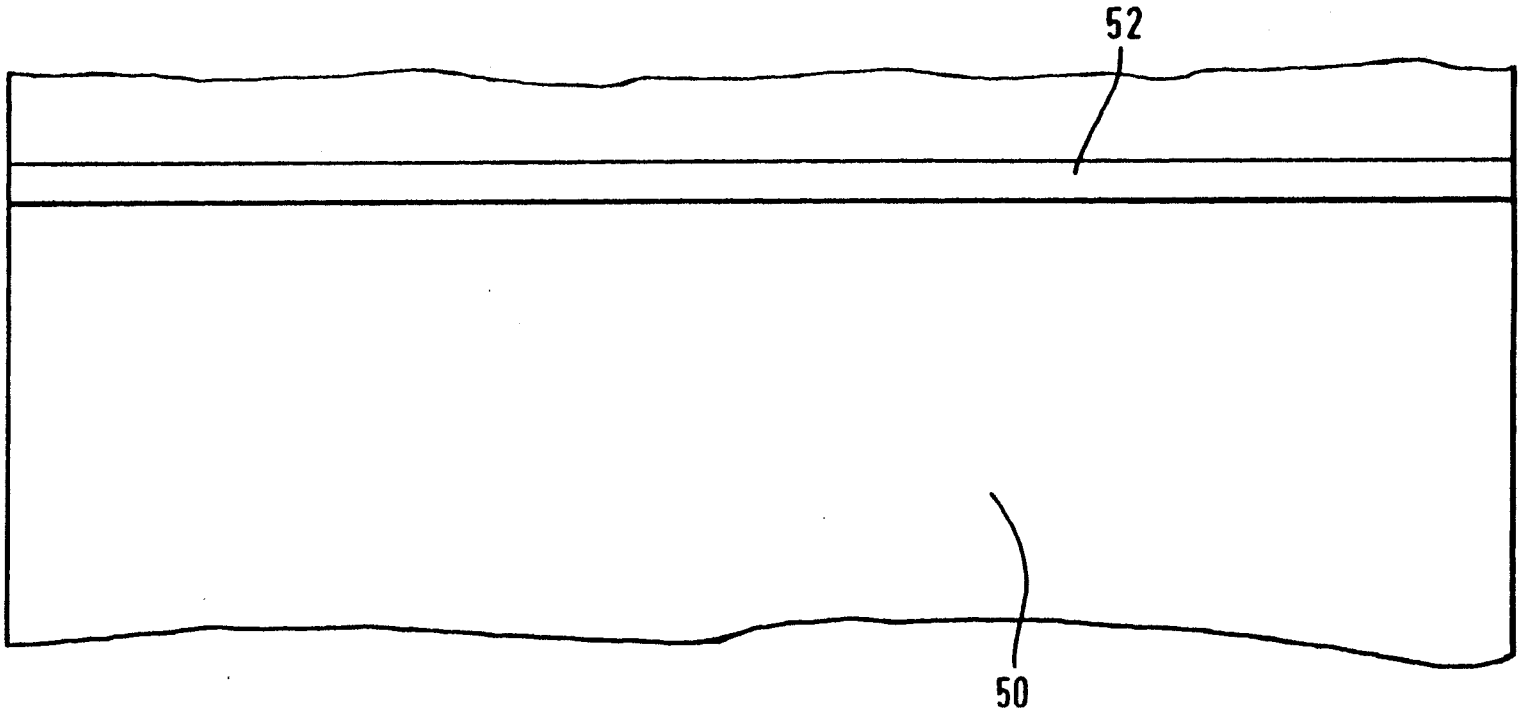
FIG. 9 to 17 show a second embodiment of the method according to the invention for the manufacture of a sack or bag.
Figure 10:
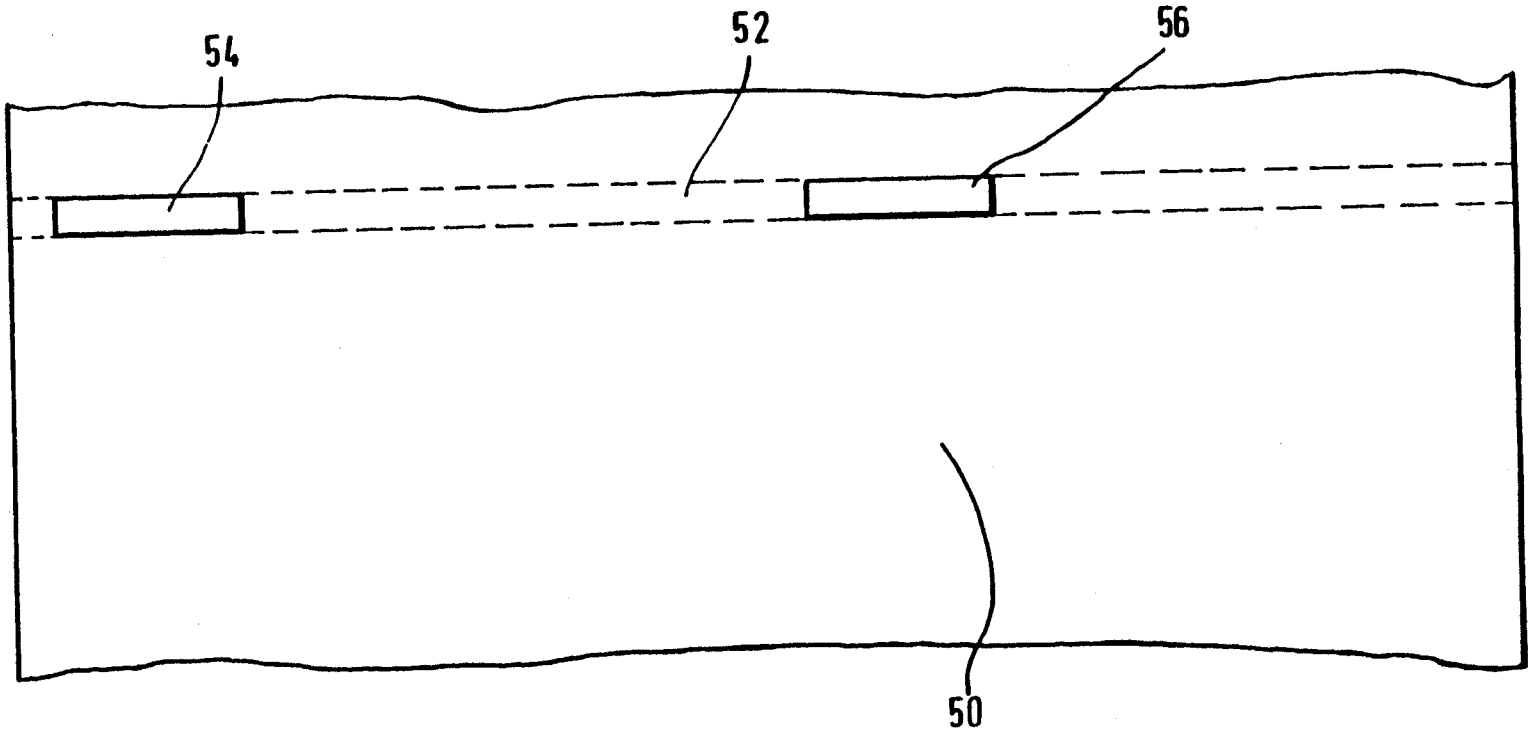

On the basis of FIGS. 9 through 17 the method according to the second embodiment of the invention can be explained. Therein it is also proceeded from a continuously advanced flat web 50, as represented in FIG. 9, which preferably consists of paper. At a distance of one bag length, respectively, a strip 52 of reactivatable adhesive or sealing-wax and extending vertically to the lateral edges is applied to one side.

In FIG. 10 there is again shown the back side of the flat web 50 in which the strip 52 is represented by broken lines since it is not visible from this point of view. On the back side of the flat web 50 two short strips 54 and 56 of reactivatable adhesive or sealing-wax are applied at a corresponding location, i.e. in a section partly being congruent with the extension of the strip 52.

Figure 11:
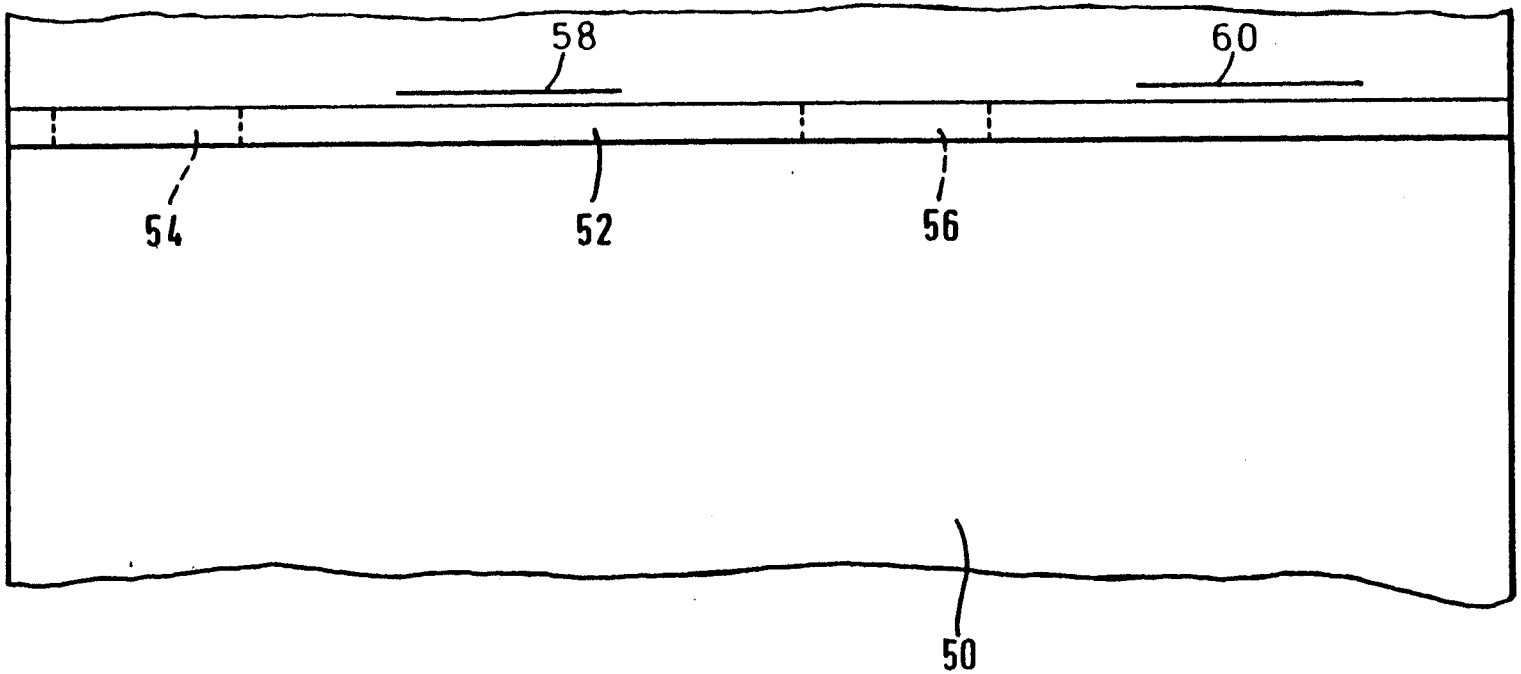
Figure 12:
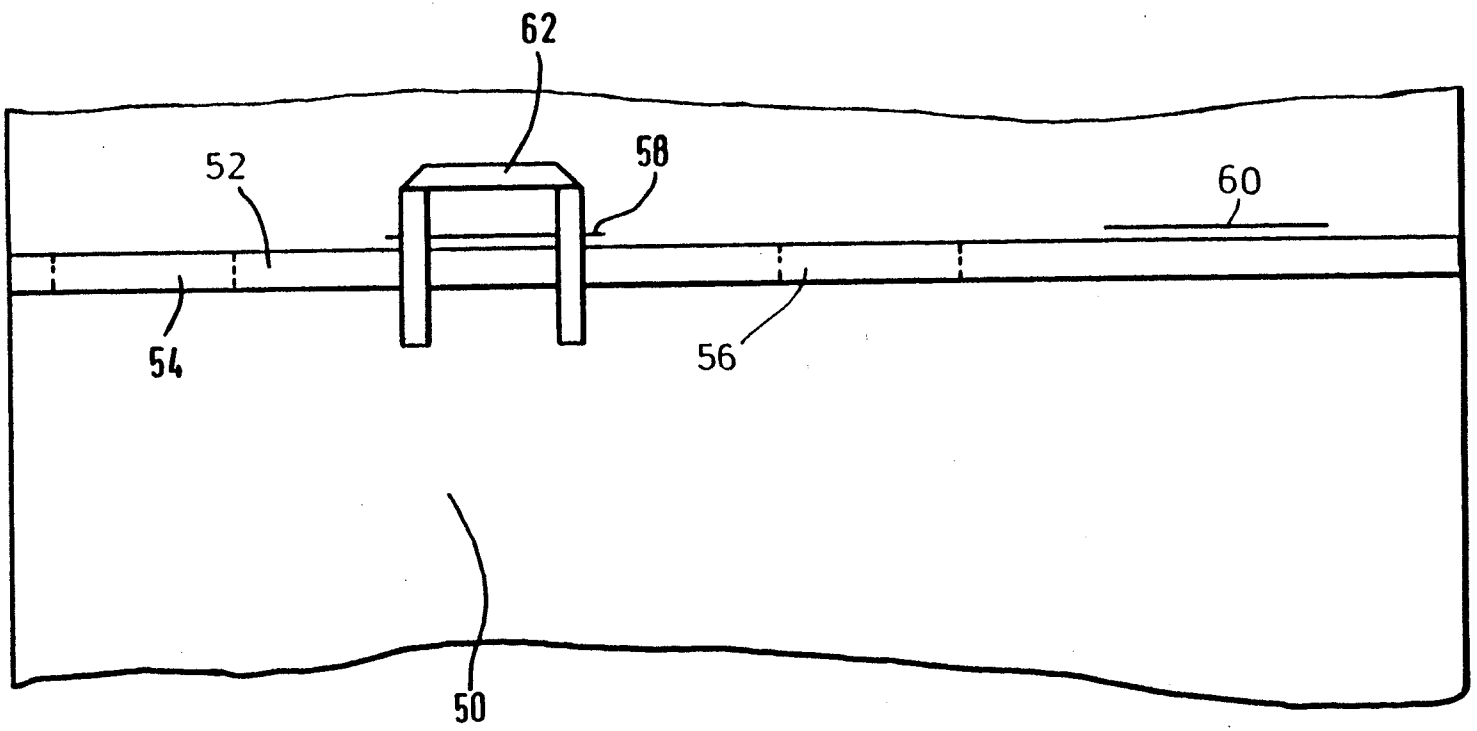
Figure 13:
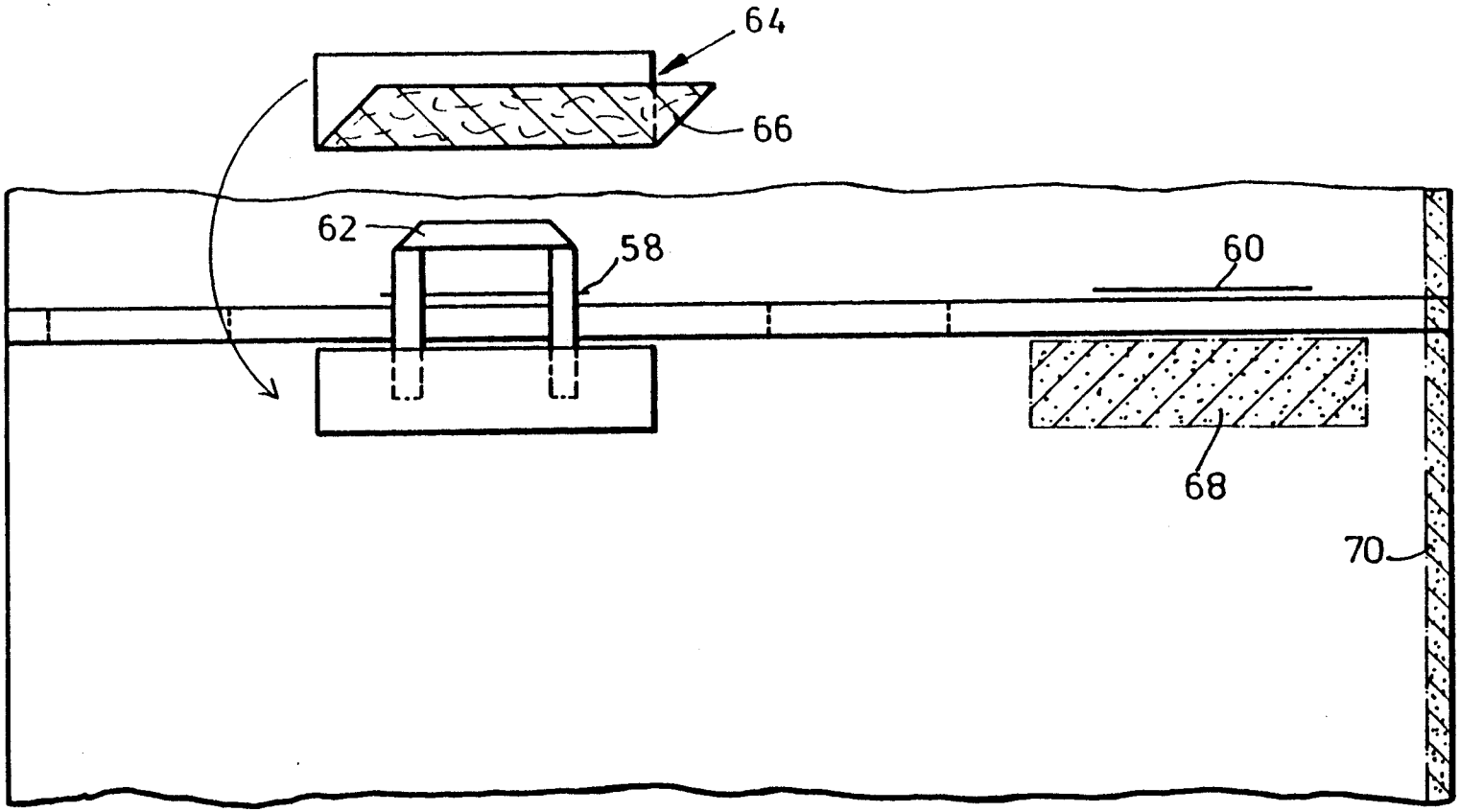

In the direction of feed of the flat web 50 two spaced apart slots 58 and 60 are provided preceding the strip 52, as shown in FIG. 11. According to FIG. 12, in the section of slot 58, a handle portion 62, also preferably consisting of paper, is glued thereon such that it juts out beyond the strip 52 and the slot 58. Said handle portion 62 is formed by a 90° folding over of the end portions of a strip-like band. The end portions of the handle 62 are glued with the flat web 50 up to the slot 58.

Figure 14A:
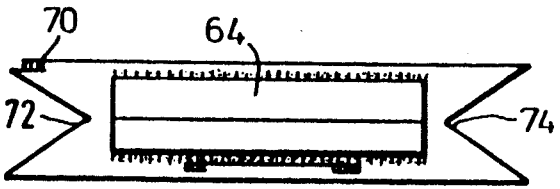
Figure 14:
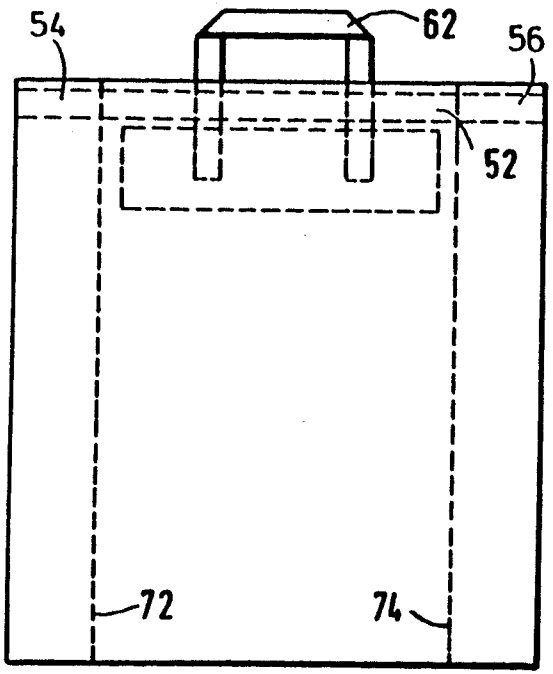

In the section of the ends of the handle portion 62 a folded sheet 64 with a leg is glued therewith such that it comes to lie on the free, glued ends of the handle, whereas the other leg is folded back on said first leg. Below the second slot 60 an area is provided with glue which in size substantially corresponds to the leg 66 of the folded sheet. As can be further seen in FIG. 13, on one side of the flat web 50 an adhesive strip 70 is applied. Then the web 50 is folded to a tube by forming lateral folds 72 and 74 such that the free leg 66 of the folded sheet 64 is arranged on the glued area 68. After the cutting in lengths of one bag, the bag as represented in FIG. 14 and 14*a* is obtained. A cutting of the bag in the section of the handle 62 is rendered possible by the fact that in the handle portion the slots 58 and 60 are already provided. Therefore, with the corresponding blade just the still uncut portion must be cut through for the separation from the subsequent bag. FIG. 14*a*, on the other hand, shows a view from below into the inside of the bag, the side walls of the bag being slightly pulled apart. Therein the sheet 64 can be seen.

Figure 15:
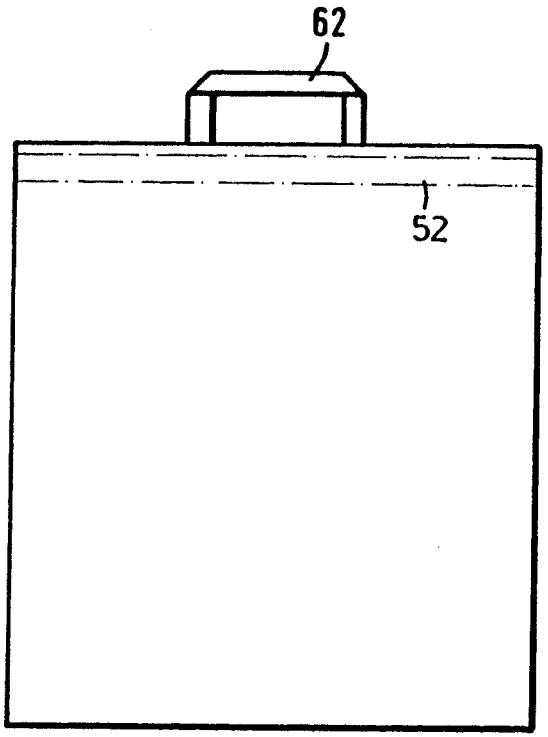
Figure 16:
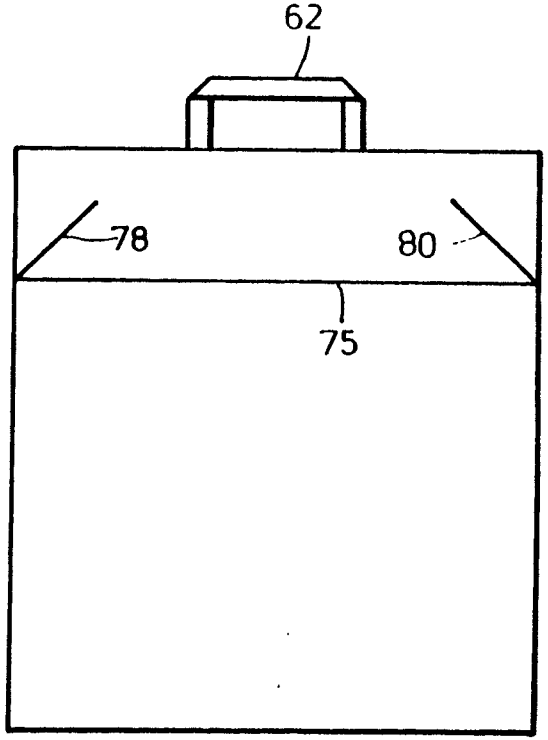

In the method step as shown in FIG. 15, the reactivatable strips 52 and the strips 54 and 56 in the area of the lateral folds 72 and 74 are activated and thereby glued with each other. In the embodiment as shown in FIG. 16 again fold lines 76, 78 and 80 are pregrooved, said lines corresponding to the fold lines 42, 44 and 46 of the first embodiment. A fold line corresponding to the fold line 40 is not provided in this embodiment.

Figure 17:
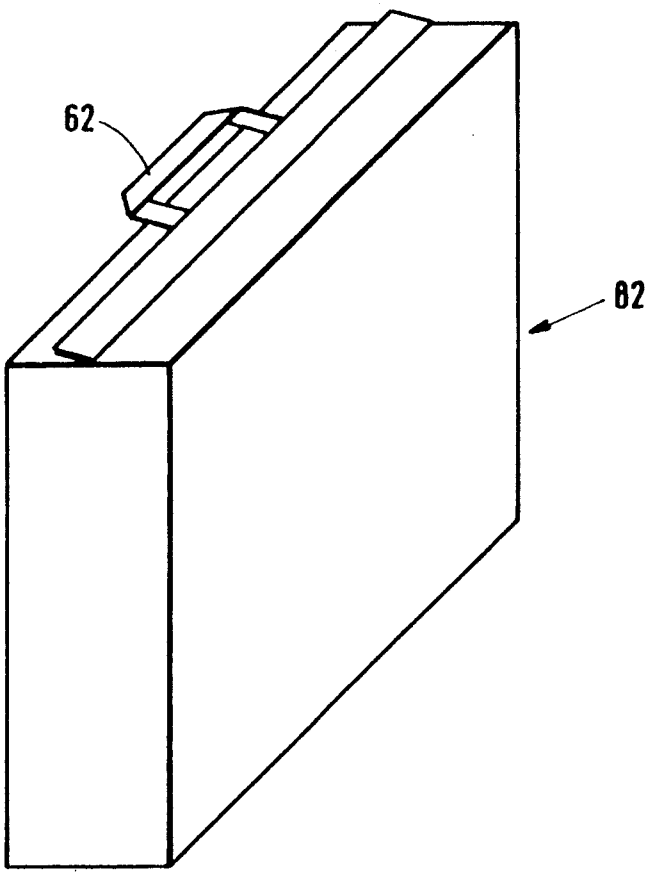

After the usual filling of the bag and the closing of the open bag end by any kind of bottom, the bundle 82 is obtained which is represented in FIG. 17. In said drawing it becomes obvious that the handle 62 together with the web portion formed above the rectangular bottom lies flat on the bottom, and this is obtained by the fact that in said embodiment no fold line is provided which corresponds to the fold line 40 of the first embodiment. It is a matter-of-course that also in the present embodiment such a fold line can be provided so that the web with the handle 62 is in a vertically standing position as represented in the first embodiment in FIG. 9. Alternatively, also the first embodiment can be designed without any such fold line 40 so that the handle would come to lie on the bottom, corresponding to the representation according to the second embodiment in FIG. 17.

The embodiment as shown in FIG. 17 shows the advantage that the bundles 82 can be easily stacked one on top of each other, without being necessary to first reversely fold the handle 62 with the respective projection.

The embodiment represented in FIGS. 18 through 25 substantially corresponds to those according to FIGS. 1 through 8.

Figure 18:
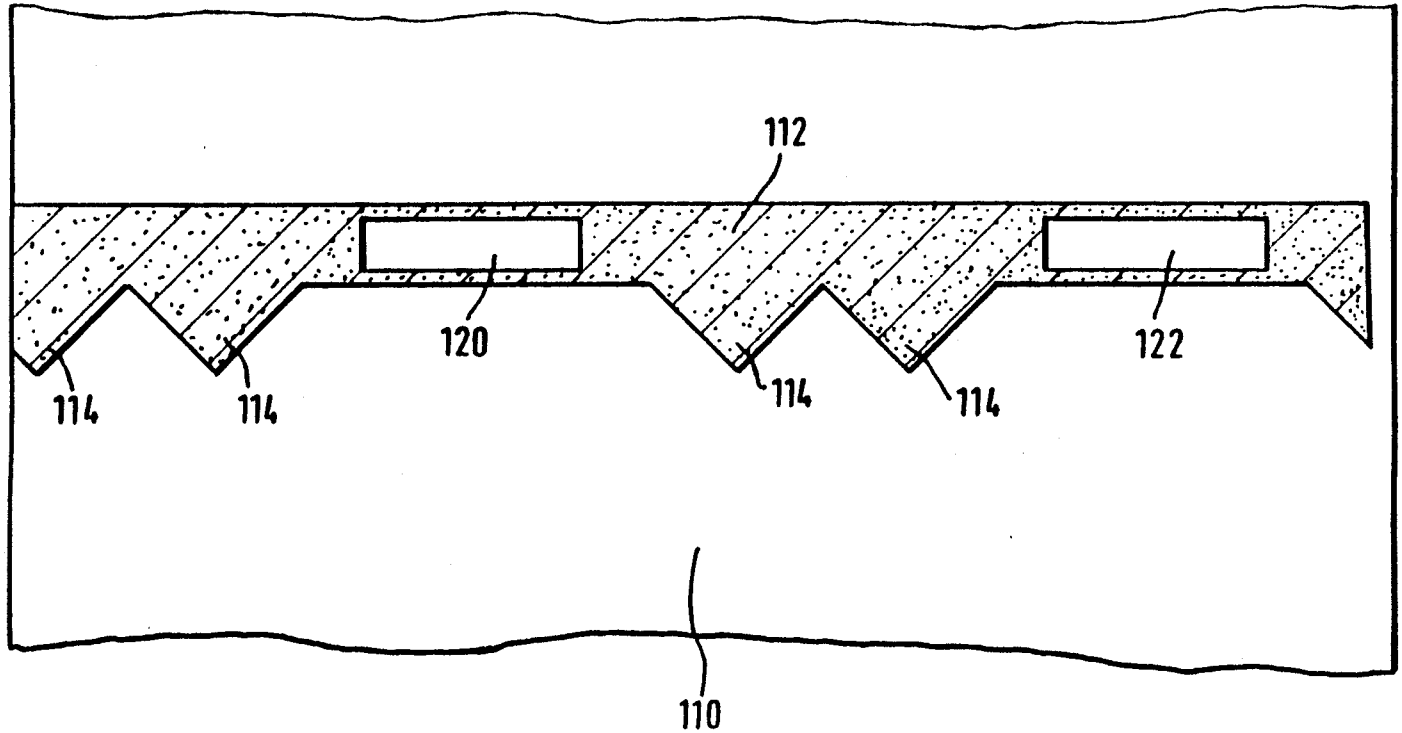
FIG. 18 to 25 show a third embodiment of the method according to the invention for the manufacture of a sack or bag.
Figure 19:
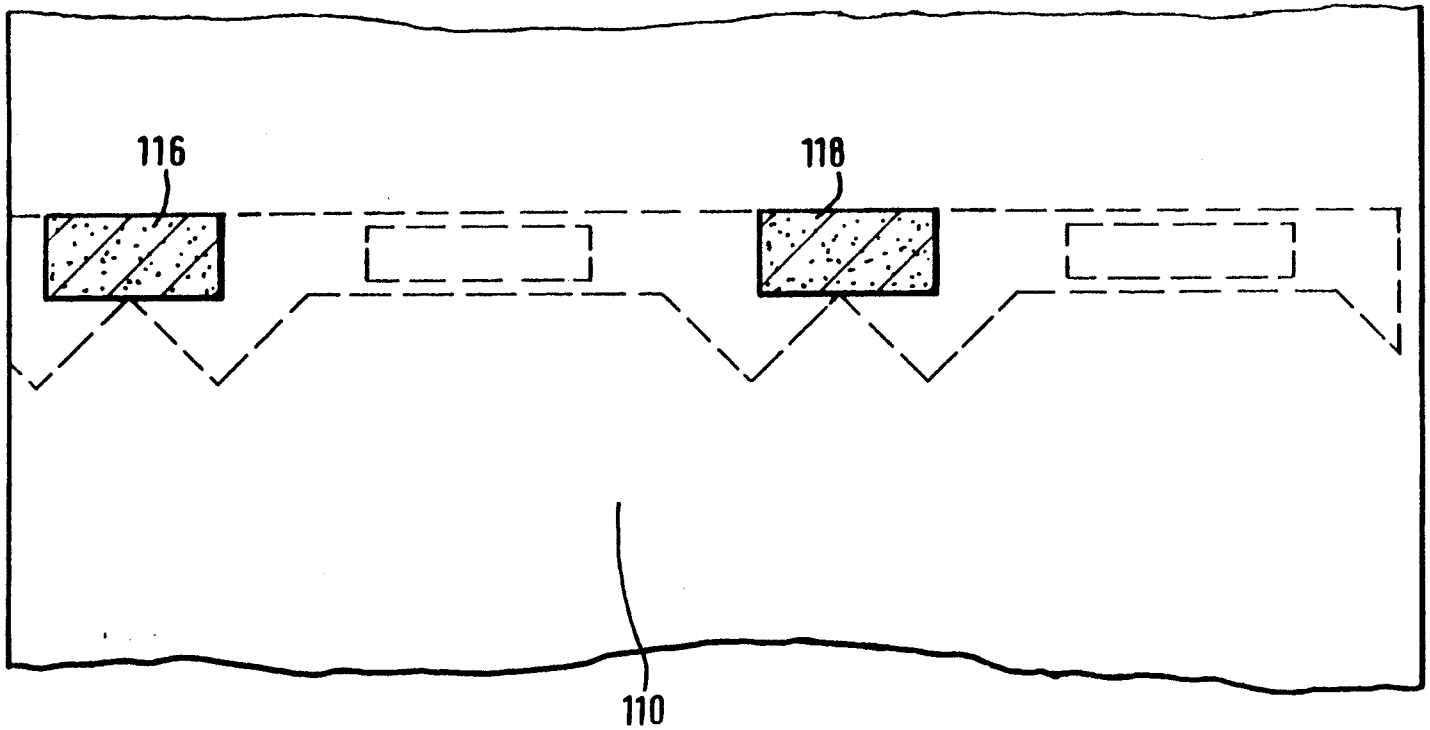
Figure 21A:
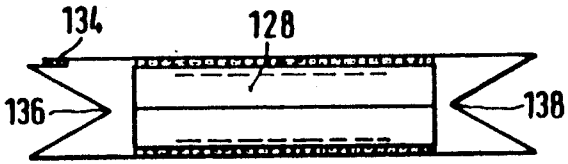
Figure 21:
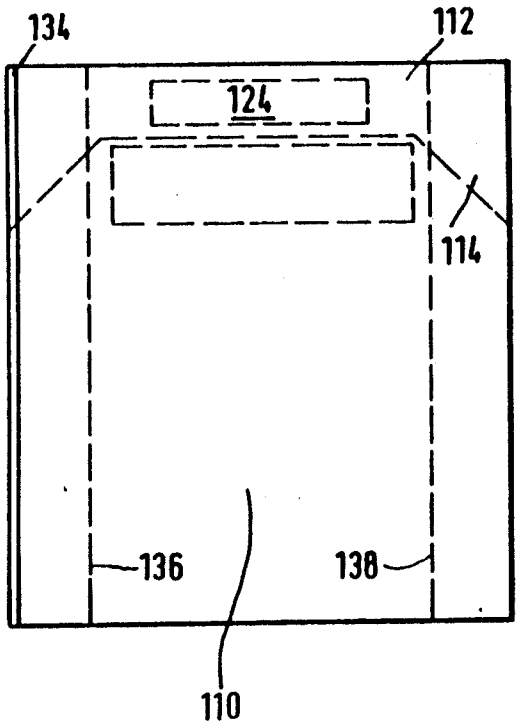

Onto a continuously advanced flat web 110 as represented in FIG. 18, at distances of one bag length respectively, relatively broad strips 112 extending vertically to the lateral edges and being of reactivatable adhesive or sealing-wax are applied on the front side. The strip 112 has projecting triangular flat sections 114 according to the design as shown in FIG. 18. The sections of the triangular sections 114 lying next to each other, respectively, correspond to the section of the lateral folds 136 and 138 as shown in FIG. 21. Within the strip 112 of reactivatable adhesive or sealing-wax, sections 120 and 122 are lect blank, i.e. without any glue or sealing-wax. The arrangement of the sparings 120, 122 can also be inferred from FIG. 18. In FIG. 19 the flat web 110 is represented from the back, the corresponding strip 112 is again represented by dashed lines as it is arranged on the opposite side. On said back side, strips 116, 118 of sealing-wax are applied in congruence with the strip 112 arranged on the other side.

Figure 20:
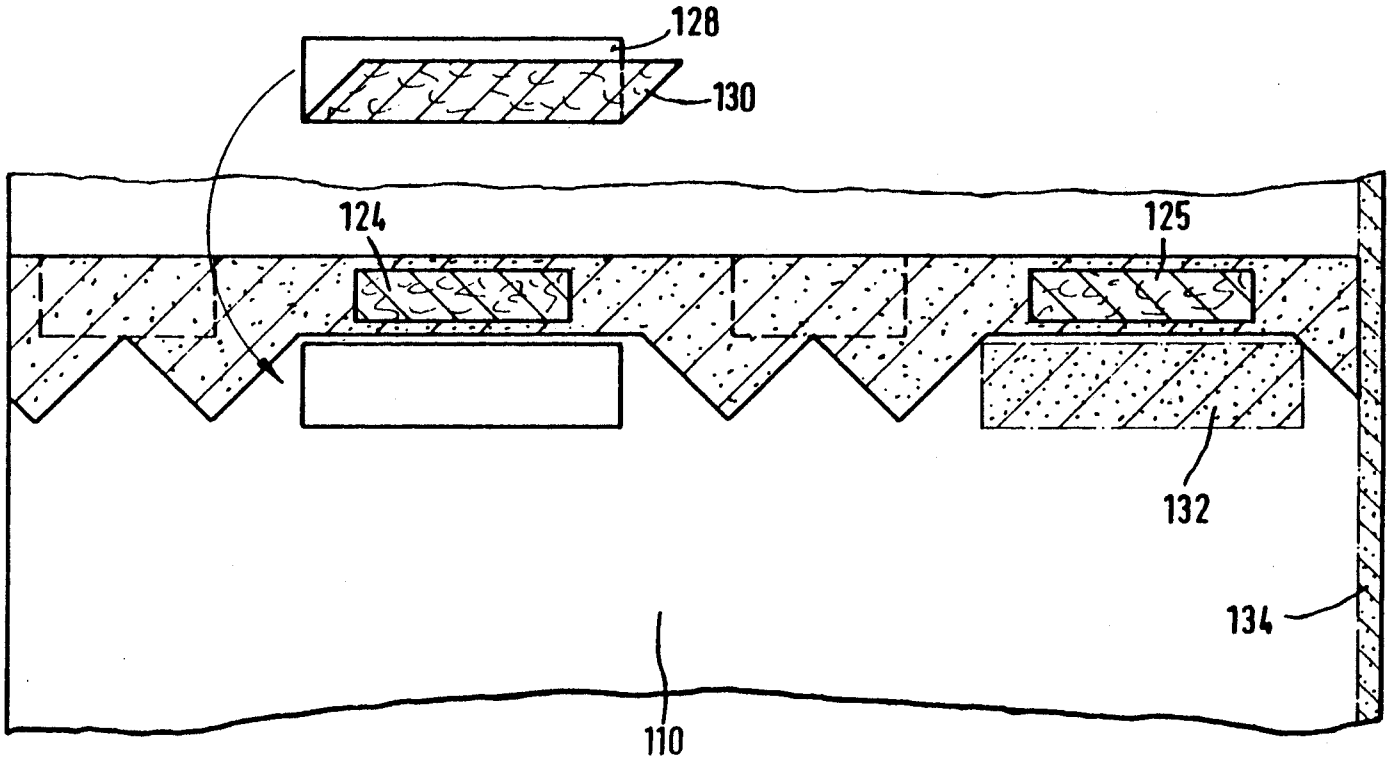

In FIG. 20, the flat web 110 is again shown from the front. In the sparings 120 and 122 of the strip 112, reinforcements 124 and 126 which are spaced apart from each other are glued thereto with their whole surface. Said reinforcements advantageously consist of solid cardboard. At their tightly glued side they are also provided with a coating of sealing-wax. Also in this case, when the material of the flat web 110 in itself is already provided with a high resistance to tearing, the additional reinforcing by the reinforcing portions 124 and 126 can be omitted.

Below and onto the reinforcement 124 a folded sheet 128 is glued. A free leg of said folded sheet 128 is also folded back onto the glued leg. Below the reinforcement 126 a glued area 132 is provided which in size corresponds to the area of the free leg 130 of the folded sheet 128. At the lateral edge of the flat web 110 an adhesive strip 134 is applied.

The flat web 110 is then folded over to form a tube with lateral folds 136 and 138, said tube, after an adequante cutting to size, showing the form as indicated in FIG. 21. In FIG. 21*a* the bag which is open at the bottom is slightly pulled apart. In the middle of the drawing the sheet 128 which is glued to the sides of the bag is represented.

Figure 22:
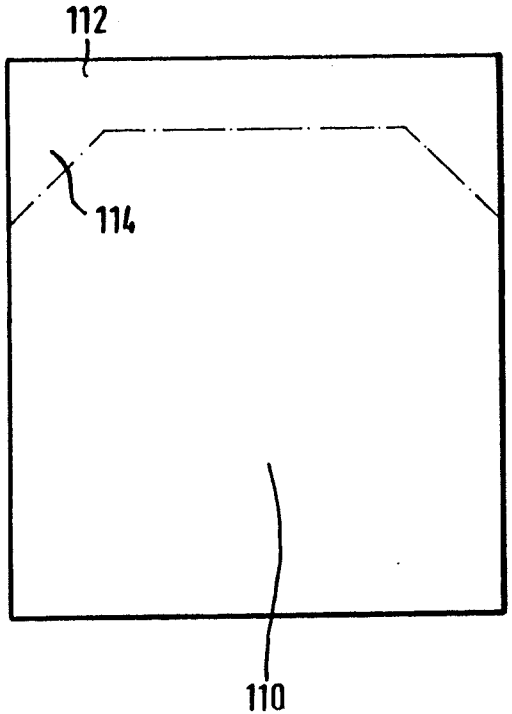

In the method step as represented in FIG. 22 the reactivatable adhesive strips or sealing-wax strips 112 together with the flat projections 114 are activated by corresponding heated rollers, i.e. they are glued with each other. Additionally, also the sealing-wax strips 116 are glued with each other in the lateral fold 136 and the strips 118 in the lateral fold 138.

Figure 23:
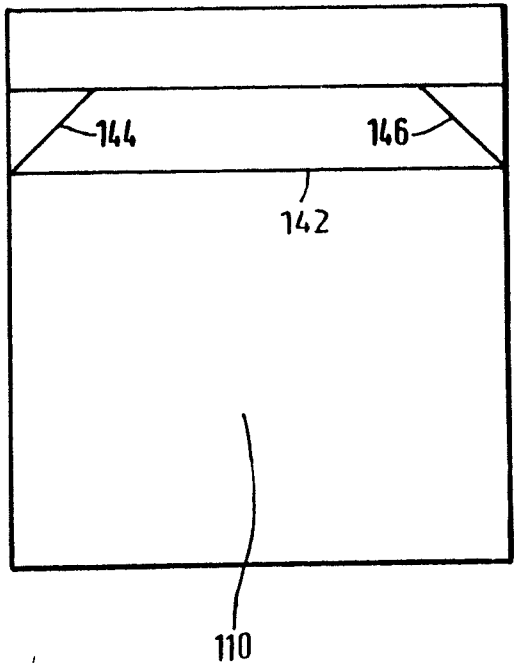

In the step shown in FIG. 23 the fold edges 140, 142, 144 and 146 are pregrooved.

Figure 24:
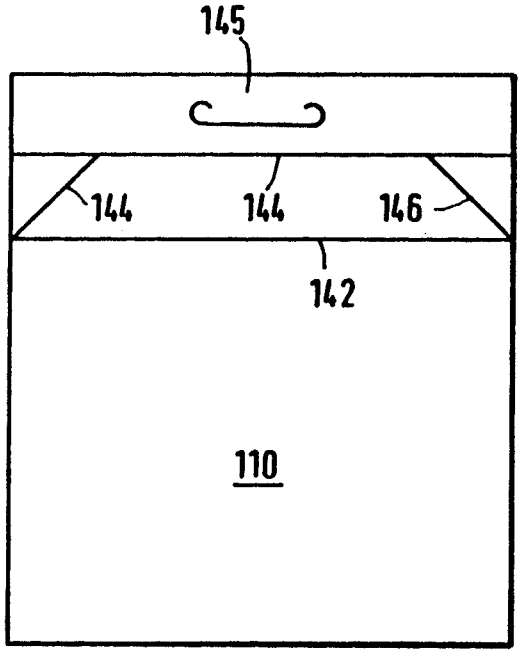

According to the step as represented in FIG. 24 a griphole punching 145 in the section of the reinforcements 124 and 126 is provided.

Figure 25:
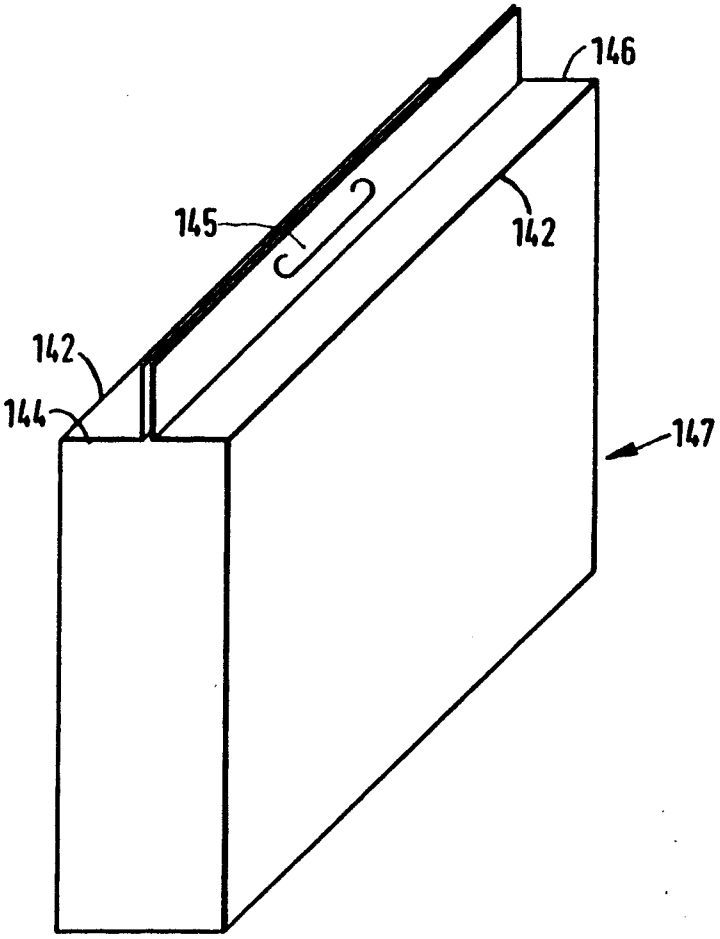

The napkin bag prepared in that manner is then filled from the bottom and closed in the lower section in a known manner, as usually, whereby the bundle 147 shown in FIG. 25 is obtained.

Figure 26:
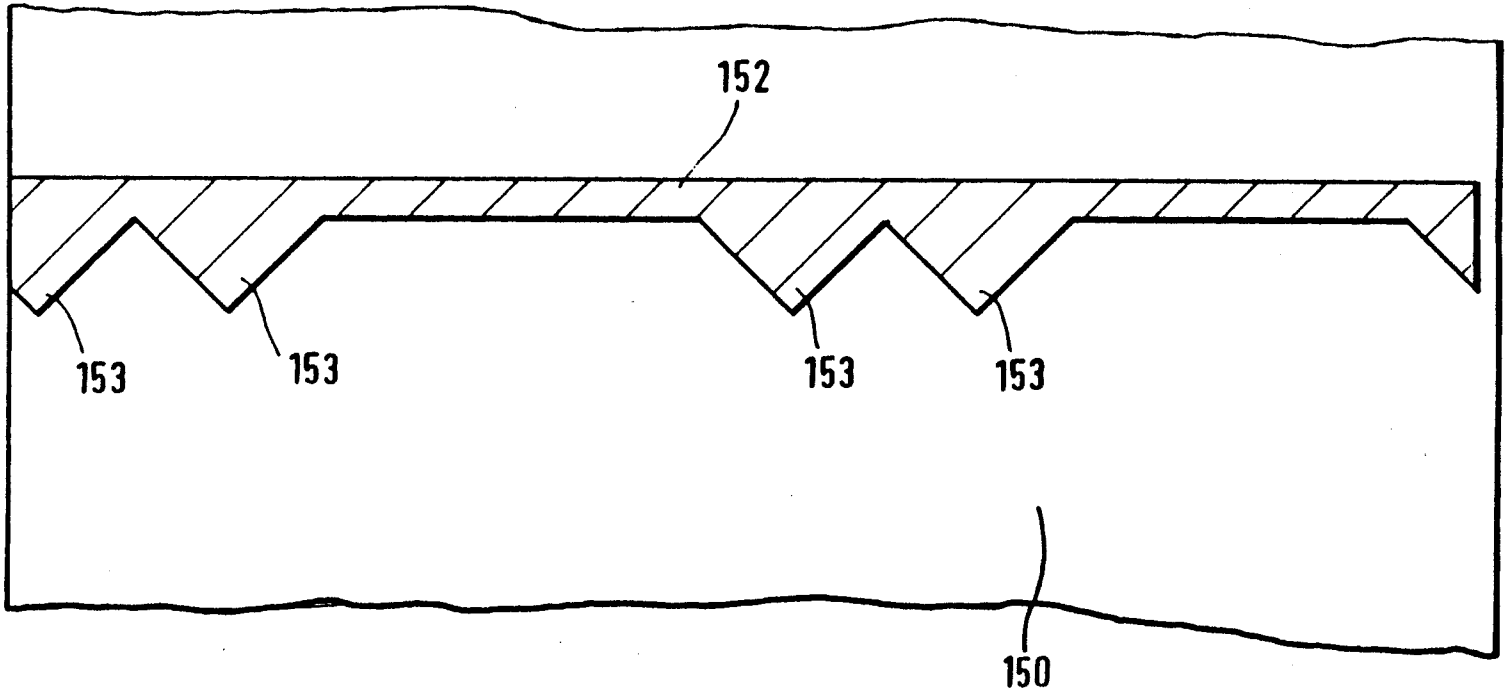

The fourth embodiment represented in FIGS. 26 through 34 substantially corresponds to the embodiment according to FIGS. 9 through 17. Also in this case it is proceeded from a continuously advanced flat web 150 preferably consisting of paper, as it is shown in FIG. 26. At distances of one bag length, respectively, a relatively broad strip 152 of reactivatable adhesive or sealing-wax and extending vertically to the lateral edges is applied to one side. Said strip, in turn, is provided with three triangular projections 153 of reactivatable adhesive or sealing-wax which are arranged adjacently in pairs.

Figure 27:
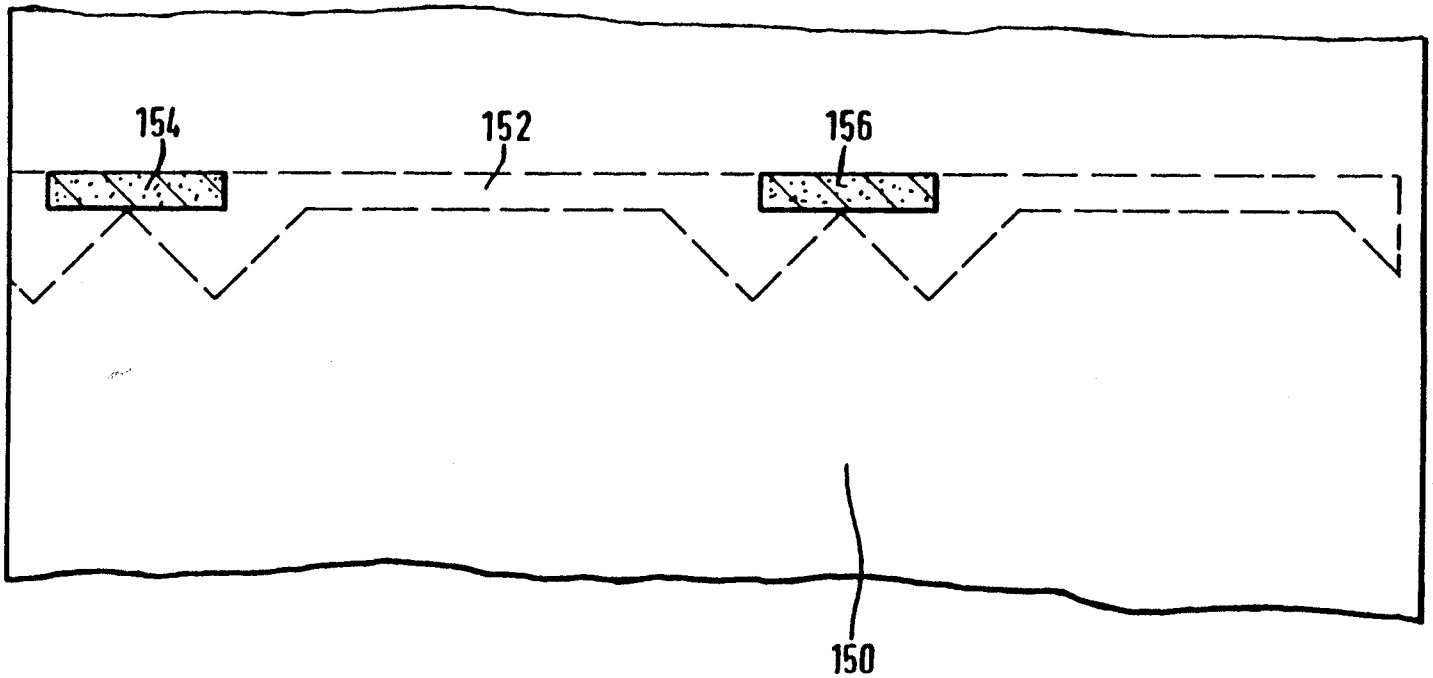

In FIG. 27 the back side of the flat web 150 is again shown in which the strip 152 is indicated by dashed lines as it is not visible in this position. On the back side of the flat web 150 two short strips 154 and 156 of reactivatable adhesive or sealing-wax are applied at a corresponding location, i.e. in a section which partly overlaps along the length of the strip 152. Said section corresponds to the section of the triangular areas 153 which are adjacently arranged on the other side.

Figure 28:
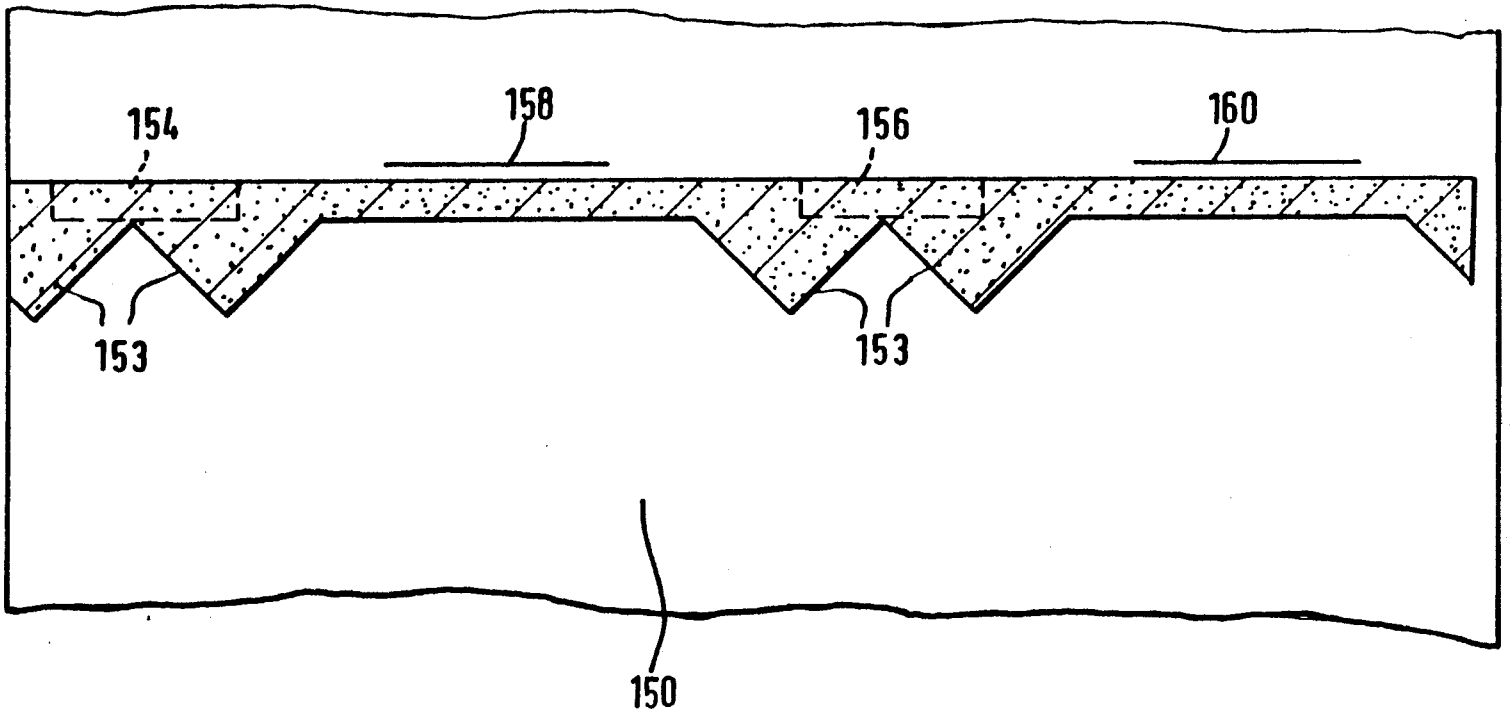
Figure 29:
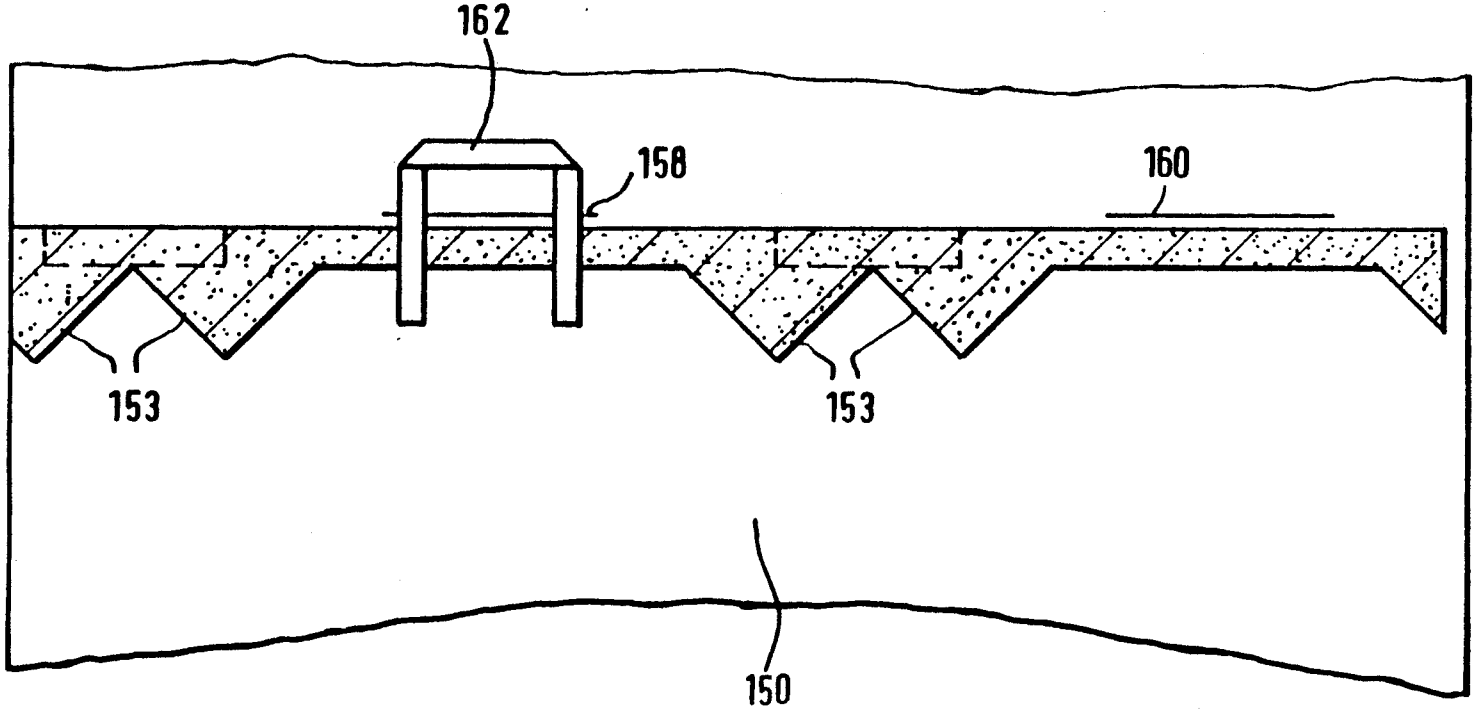
Figure 30:
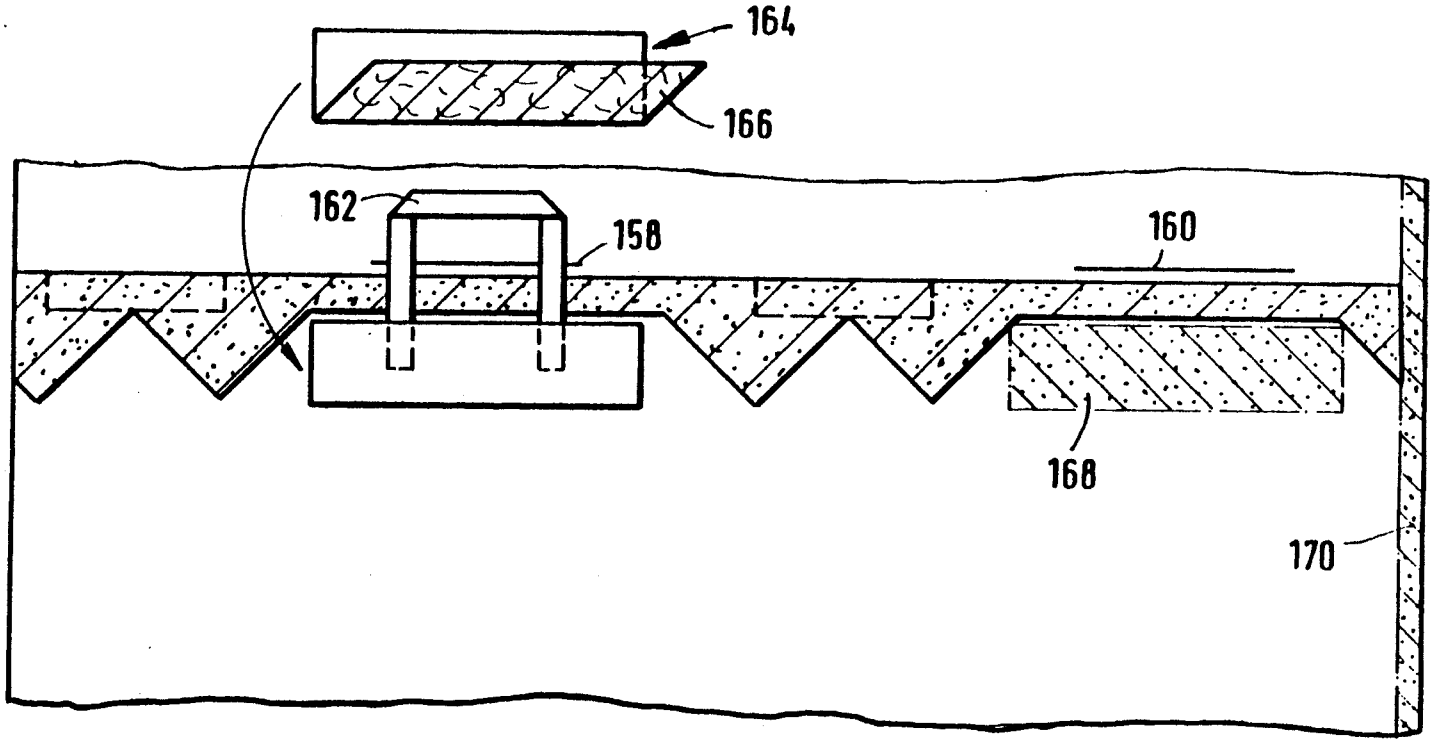

In the direction of feed of the flat web 150 two slots 158 and 160 which are spaced apart from each other are provided preceding the strip 152, which is shown in FIG. 28. According to FIG. 29 in the section of slot 158 a handle portion 162 also preferably consisting of paper is glued on in a manner that it juts out beyond the strip 152 and the slot 158. Said handle portion 162 is formed in the same manner as the handle portion 62. The end portions of the handle 162 are glued with the flat web 150 up to the slot 158.

In the zone of the end portions of the handle portion 162 a folded sheet 164 with a leg is glued in a manner that it comes to lie on the free and glued end portions of the handle portion, whereas the other leg is folded back onto said first leg. Below the second slot 160 an area is provided with glue, the size of said glued area substantially corresponding to leg 166 of the folded sheet. As can further be inferred from FIG. 30, on one side of the flat web 150 an adhesive strip 170 is applied.

Then the web 150 is folded to a tube by forming lateral folds 172 and 174 such that the free leg 166 of the folded sheet 164 will be arranged on the glued area 168. After cutting in lengths of one bag, the bag as represented in FIG. 31 and 31*a* is obtained.

In the method step shown in FIG. 32, the reactivatable strips 152 together with the triangular sections 153 and the strips 154 and 156 are activated and thereby glued with each other. According to FIG. 33 the fold lines 176, 178 and 180 are formed which in their arrangement corrrespond to that of the embodiment shown in FIG. 17.

Figure 34:
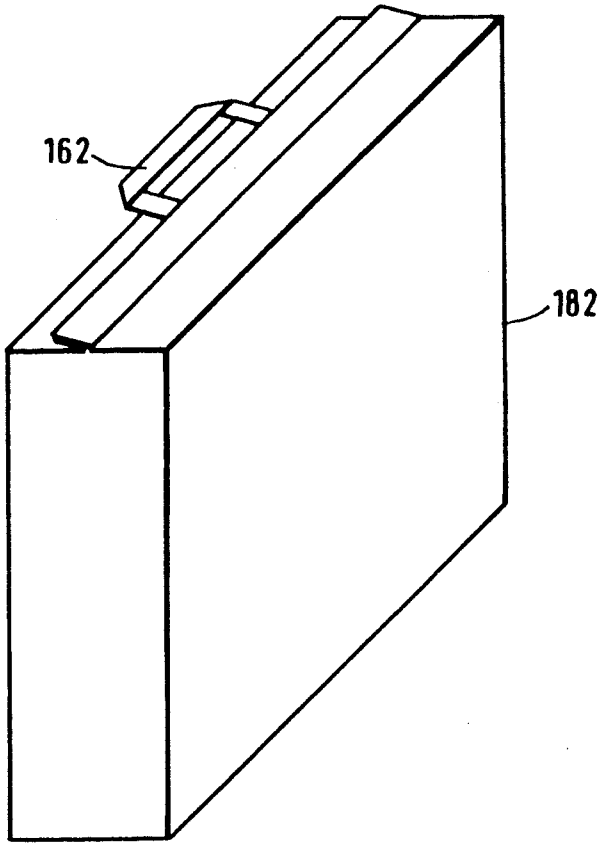

After the usual filling of the bag and the closing of the open bag end by any kind of bottom, the bundle 182 as shown in FIG. 34 is obtained The sacks or bags manufactured in accordance with the method according to the invention are advantgeously not provided with handle portions in the section of the side walls and therefore can be printed over the whole area.

We claim:

1. Method for manufacturing a sack or bag with a bottom being rectangular in the filled state and with a handle, consisting of the following steps:

a) onto a continuously advanced flat web (10) two strips (12,14) of reactivatable adhesive or sealing-wax and extending in parallel to each other and vertically to the lateral edges are applied at distances of one bag length, respectively, b) at the corresponding location of the back side of the flat web (10) four short strips (16, 18, 20, 22) of reactivatable adhesive or sealing-wax are applied, c) between the strips (12,14) of reactivatable adhesive or sealing-wax two reinforcements (24, 26) are glued thereon with their whole surface, d) below and onto the first reinforcement a folded sheet (28) with a leg is glued, whereas the other leg (30) is folded back thereon, e) below the second reinforcement (26) an area (32) is provided with glue which in size corresponds to the leg (30), f) on one side of the flat web (10) an adhesive strip (34) is applied, g) the web (10) is folded to a tube by forming lateral folds (36, 38) such that the free leg (30) is arranged on the glued area (32) and that simultaneously the two reinforcements (24,26) are arranged on top of each other, h) the reactivatable adhesive strips or sealing-wax strips (12,14;16,18,20,22) are activated, i) fold edges (40,42,44,46) are pregrooved, j) in the section of the reinforcements (24,26) lying on top of each other a griphole (45) is cut in by punching.

2. Method for manufacturing a sack or bag with a bottom being rectangular in the filled state and with a handle portion, consisting of the following steps:

a) onto a continuously advanced flat web (50) a strip (52) of reactivatable adhesive or sealing-wax and extending vertically to the lateral edges is applied on one side at distances of one bag length, respectively, b) at a corresponding location of the back side of the flat web (50) two short strips (54,56) of reactivatable adhesive or sealing-wax are applied, c) in the running direction of the flat web (50) preceding the strip (52) and parallel thereto two slots (58,60) spaced apart from each other are provided, d) in the section of at least one of the slots (58) at least one handle portion (62) is glued on the flat web (50) such that it juts out beyond the strip (52) and the slot (58), e) a folded sheet (64) with a leg is glued such that it comes to lie on the free, glued ends of the handle (62), whereas the other leg (66) is folded back thereon, f) below the second slot (60) an area (68) is provided with glue the size of which corresponds to the leg (66) of the folded sheet (70), g) on one side of the flat web (50) an adhesive strip (70) is applied, h) the web (50) is folded to a tube by forming lateral folds (72,74) such that the free leg (66) of the folded sheet (64) is arranged on the glued area (68), i) the reactivatable strips of adhesive or sealing wax (52;54,56) are activated, j) fold edges (76,78,80) are pregrooved.

3. Method for manufacturing of a sack or bag with a bottom being rectangular in the filled state and with a handle portion, consisting of the following steps:

a) onto a continuously advanced flat web (110) a strip (112) of reactivatable adhesive or sealing-wax and extending vertically to the lateral edges is applied on one side at distances of one bag length, respectively, wherein said strip in the section of lateral folds to be provided lateron is provided with adjacent triangular areas (114), b) at corresponding locatons of the back side of the flat web (110) two flat strips (116,118) of reactivatable adhesive or sealing-wax are applied, c) below and onto the strip (112) in the section of a later side wall between two triangular flat projections (114) a folded sheet (128) with a leg is glued, whereas the other leg (130) is folded back thereon, d) below the strip (112) on the opposite side wall an area (132) is provided with glue in a size which corresponds to the leg (130), e) on one side of the flat web (110) an adhesive strip (134) is applied, f) the web (110) is folded to a tube by forming lateral folds (136,138) such that the free leg (130) is arranged on the glued area (132), g) the reactivatable adhesive strips or sealing-wax strips (112,116) are activated, h) fold edges (140,142,144,146) are pregrooved, i) a griphole (145) is punched.

4. Method for manufacturing a sack or bag according to claim 3, wherein in the strip (112) of reactivable adhesive or sealing-wax two areas, respectively, are left blank during the application of the strip (112) onto which reinforcements (124,126) are glued with their whole surface, wherein the side of the reinforcements which is not glued is preferably also covered with reactivatable adhesive or sealing-wax.

5. Method for manufacturing a sack or bag with a bottom being rectangular in the filled state and with a handle portion, consisting of the following steps:

a) onto a continuously advanced flat web (150) a strip (152) of reactivatable adhesive or sealing-wax and extending vertically to the lateral edges is applied on one side at disances of one bag length, respectively, which in the sections of the later lateral folds is provided with two projecting triangular areas (153) also of reactivatable adhesive or sealing-wax, respectively, b) at a corresponding location of the back side of the flat web (150) two short strips (154,156) of reactivatable adhesive or sealing-wax are applied, c) in the running direction of the flat web (150) preceding the strip (152) and parallel thereto two slots (158,160) spaced apart from each other are provided, d) in the section of at least one of the slots (158) at least one handle portion (162) is glued onto the flat web (150) such that it juts out beyond the strip (152) and the slot (158), e) a folded sheet (164) with a leg is glued such that it comes to lie on the free, glued ends of the handle (162), whereas the other leg (166) is folded back thereonto, f) below the second slot (160) an area (168) is provided with glue which in size corresponds to the leg (166) of the folded sheet (164), g) on one side of the flat web (150) an adhesive strip (170) is applied, h) the web (150) is folded to a tube by forming lateral folds (172,174) such that the free leg (166) of the folded sheet (164) is arranged on the glued area (168), i) the reactivatable strips of adhesive or sealing-wax (152;154,156) are reactivated, j) fold edges (76,78,80) are pregrooved.

* * * * *